US006522261B2

(12) United States Patent
Scheffler et al.

(10) Patent No.: US 6,522,261 B2
(45) Date of Patent: Feb. 18, 2003

(54) SELECTABLE CANDELA STROBE UNIT

(75) Inventors: Daniel C. Scheffler, Winfield, IL (US); Curtis R. Davidson, Oswego, IL (US); Joel D. Kwasny, Romeoville, IL (US)

(73) Assignee: Pittway Corporation, St. Charles, IL (US)

( * ) Notice: Subject to any disclaimer, the term of this patent is extended or adjusted under 35 U.S.C. 154(b) by 0 days.

(21) Appl. No.: 09/962,015

(22) Filed: Sep. 24, 2001

(65) Prior Publication Data

US 2002/0075473 A1 Jun. 20, 2002

Related U.S. Application Data

(60) Provisional application No. 60/235,526, filed on Sep. 26, 2000.

(51) Int. Cl.[7] ..... G08B 5/36

(52) U.S. Cl. ..... 340/815.73; 340/815.4; 340/815.49; 340/693.5; 340/693.9; 340/691.4; 340/691.5; 362/5; 362/295

(58) Field of Search ..... 340/815.4, 815.49, 340/815.73, 815.76, 331, 332, 693.5, 693.9, 693.11, 693.12, 691.1, 691.4, 691.5, 691.6, 691.7; 361/600; 362/5, 295; 250/239, 216, 214.1

(56) References Cited

U.S. PATENT DOCUMENTS

| | | | | |
|---|---|---|---|---|
| 5,448,462 A | | 9/1995 | Moran, III | |
| 5,654,794 A | * | 8/1997 | Rutter et al. | 356/151 |
| 5,931,569 A | | 8/1999 | Anderson | |
| 5,969,627 A | * | 10/1999 | Tarlton et al. | 340/693.12 |
| 6,127,935 A | * | 10/2000 | Davidson et al. | 340/691.5 |
| 6,133,843 A | * | 10/2000 | Davidson | 340/693.9 |
| 6,271,763 B1 | * | 8/2001 | Hur | 340/693.12 |

* cited by examiner

*Primary Examiner*—Daniel J. Wu
*Assistant Examiner*—Daniel Previl
(74) *Attorney, Agent, or Firm*—Welsh & Katz, Ltd.

(57) ABSTRACT

A multi-candela output device for indicating alarm conditions has an output section, visible after installation, and a mounting section not visible after installation. A candela output level can be set by positioning a manually adjustable member on the mounting section. An indicator of the setting is visible on the output section.

33 Claims, 7 Drawing Sheets

SELECTABLE CANDELA STROBE UNIT

The benefit of the filing date of Sep. 26, 2000 of Provisional Application Ser. No. 60/235,526 is hereby claimed.

FIELD OF THE INVENTION

The invention pertains to visual, alarm indicating output devices for monitoring systems. More particularly, the invention pertains to adjustable forms of such output devices.

BACKGROUND OF THE INVENTION

Known types of alarm systems often include audible and/or visible output devices. Two nominal voltage ranges, 8 to 17 and 16 to 33, are available for driving such devices.

Known visible output devices can output a predetermined light level, expressed in candelas, Known devices have provided some flexibility in being able to select an output light level for a predetermined driving voltage range. In known devices, this has been accomplished in several different ways.

In one type of known product, components are physically changed in the field to produce an installed product of desired brightness. This could be done with discrete components or plug-in modules.

Alternately, components can be switched, in a hardwired design using a multi-position switch. In this configuration, all components are installed and selecting one setting of the switch couples the respective selected components to the rest of the circuit to produce a hardwired circuit configuration which results in the desired brightness. Unselected components are switched out of the circuit and are nonfunctional. In this product, the switch is located on the electrical mounting box side of the strobe unit.

In yet another configuration, a front mounted slide switch can be set to a desired position and then concealed with a snap-on cover. In this configuration, a charging frequency parameter is altered by the slide switch to produce a desired brightness. This product does not alter a duty cycle parameter in a fixed charging frequency environment. Instead, a multi-terminal inductor is combined with different resistors to alter a charging frequency of the strobe.

It has been recognized that there is an advantage in reduced manufacturing costs and enhanced flexibility in being able to provide a single adjustable visual output device which can be connected to alarm systems which output either of the available driving voltage ranges. One such visual output device has been disclosed in U.S. patent application, Ser. No. 09/767,897, entitled "Processor Controlled Strobe", filed Jan. 23, 2001, assigned to the assignee hereof and incorporated herein by reference. The strobe unit therein discloses circuitry for selecting a candela output substantially independently of the applied driving voltage.

There continues to be a need for reliable and easy to use adjustment structures that can be used with variable output strobe units. Preferably such structures can be used to set the desired light output level at installation without having to be concerned about the amplitude of the applied driving voltage. It would also be desirable if the setting was visible after the fact but at the same time was substantially tamper-proof.

SUMMARY OF THE INVENTION

An adjustable alarm indicating device has an indicating side and a mounting side. An output parameter of the alarm indicator can be set on the mounting side. When installed, the set parameter value can not be altered.

In one embodiment, a multi-candela output device has a housing which carries a source of illumination. The source is visible after the device has been installed.

Prior to installation, an output candela level can be set by manually adjusting a slidable or rotary member mounted on a surface of the device which is not visible or accessible once the device has been installed. An output indicator, coupled to the adjusting member is visible after installation.

In another aspect, a visual alarm unit has a mounting structure for attachment to an electrical box. When attached to the box, a first side of the unit extends toward the interior of the box providing a secure tamper-proof region that is not accessible. A second side of the unit carries the visual output device and extends away from the box.

An output light level can be manually set at the first side by means of a setting switch or adjustable mechanical member. When installed on the box, the setting switch or member is contained in the tamper-proof region.

A visual output indicator is located on the second side. The output indicator is linked to the setting switch or adjustable member and provides visual confirmation of the preset output light level.

Thus, prior to installation, the output light level of a respective unit can be easily set without any need for special tools., Once installed, the setting of the unit can not be altered but it can be visually confirmed.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
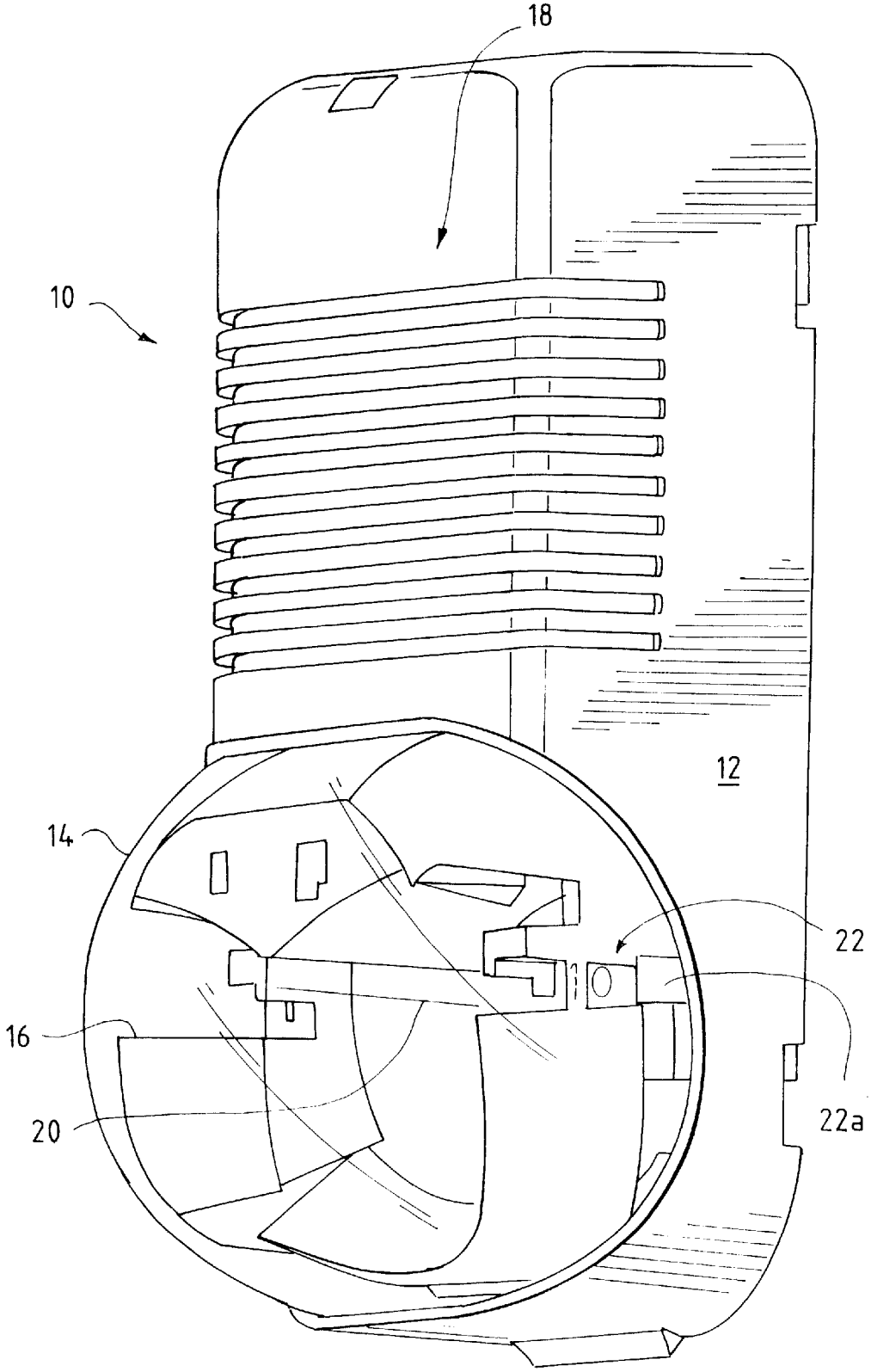
FIG. 1 is an over-all perspective view of a visual output unit in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates an exemplary selectable parameter alarm output strobe unit 10 in accordance with the present invention. The unit 10 includes a housing 12 of a type attachable to a conventional electrical box of the sort used in alarm systems.

In an exemplary embodiment, the housing 12 carries a clear transparent lens 14 which encloses a reflector 16. A radiant energy source 20 such as a dischargeable, flashable, gas-filled tube is carried on the reflector so as to produce predefined light patterns when flashed, as would be understood by those of skill in the art.

Unit 10 could be implemented as an audible output unit. Alternately, unit 10 could include both audible and visible outputs.

The unit 10 includes a visual display member 22 which carries a variable readable indicator of a pre-selected candela output level from the source 20. As explained in more detail subsequently, the display 22 is variable and adjustable in accordance with a pre-selected output level.

Figure 2:
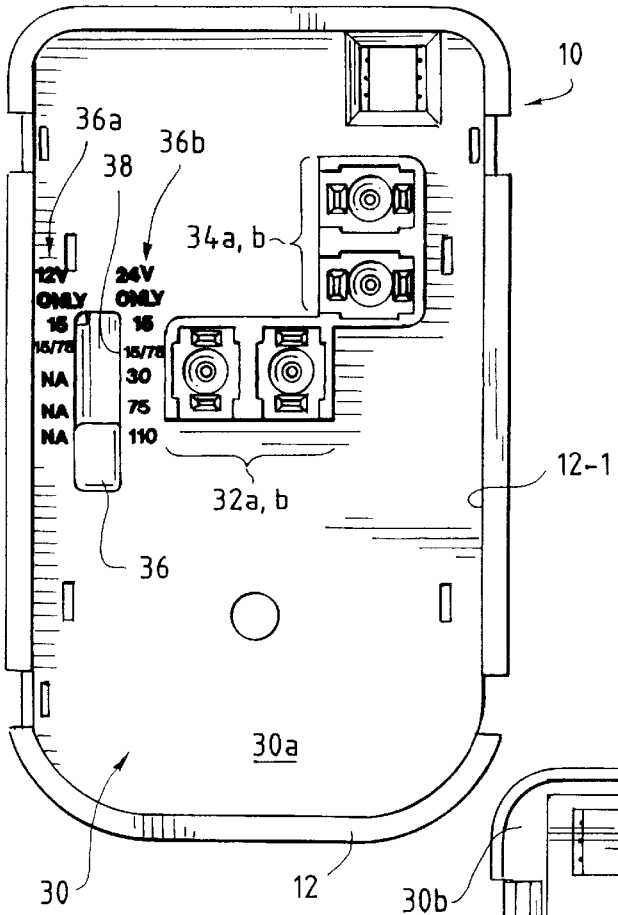
FIG. 2 is a bottom plan view of the unit of FIG. 1.

FIG. 2 is a rear view of the unit 10. The housing 12 defines an interior component receiving region 12-1 which is closed by a rear member or wall 30. The rear member or wall 30 carries a plurality of electrical connectors, such as 32*a, b*, 34*a, b* to facilitate connection to electrical conductors in the box to which the unit is to be mounted. As will be understood by those of skill in the art, unit 10 can be mounted to the electrical box by a variety of mechanical connections without departing from the spirit and scope of the present invention.

A manually movable selection member 36 is carried on the back surface 30*a* of wall 30. The selection member 36 can be adjusted so as to set the output candela level from the unit 10 before installing the unit 10 on the electrical box. The slidable member 36 can be moved to, or set to a selected one of a plurality of output candela indicia 36*a*, 36*b*. The member 36 is set to a desired position prior to installation of the unit 10 on the respective electrical box.

Once installed on the electrical box, the wall 30*a* is on the side of the unit 10 which faces toward the electrical box and the lens 14 faces away from the electrical box. The unit 10 covers the electrical box precluding access to the manually adjustable member 36 while the unit 10 is mounted on the box.

As the manually movable member 36 is slid to its desired position, the variable indicator 22 tracks the setting thereof. Once the unit 10 has been installed on the electrical box, the indicator 22 provides a visual indicium of the preset output level without providing any access to the level setting member 36. Hence, an inspector walking through a region being monitored would be able to immediately ascertain the candela output level of units such as the unit 10.

It will also be understood that the unit 10 could incorporate an audible output unit indicated generally at 18. If desired, and without departing from the spirit and scope of the present invention, an audible output parameter can be manually set with a settable member comparable to the member 36. Additionally, a supplemental display, corresponding to the display 22 can be provided to indicate the preset parameter for the audible output device.

Figure 3:
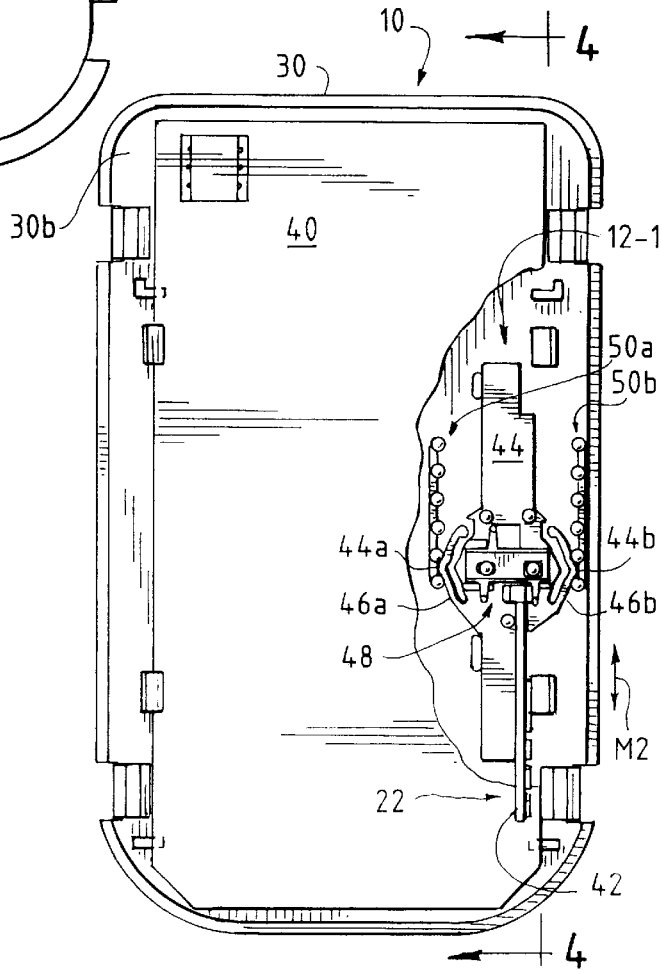
FIG. 3 is a top plan view of a portion of the unit of FIG. 1 with the housing, and reflector assembly removed and with an internal printed circuit board partly broken away.

FIG. 3, a top plan view of a portion of the unit 10, illustrates some of the details of the manually settable member 36. Within a region enclosed by the housing 12 and bounded by the base 30, is a printed circuit board 40. The board 40, partly broken away in FIG. 3, is usable to carry electrical components for the unit 10 and to effect electrical connections therebetween. The printed circuit board 40 also carries the reflector 16 as well as movable indicator 22.

Figure 4:
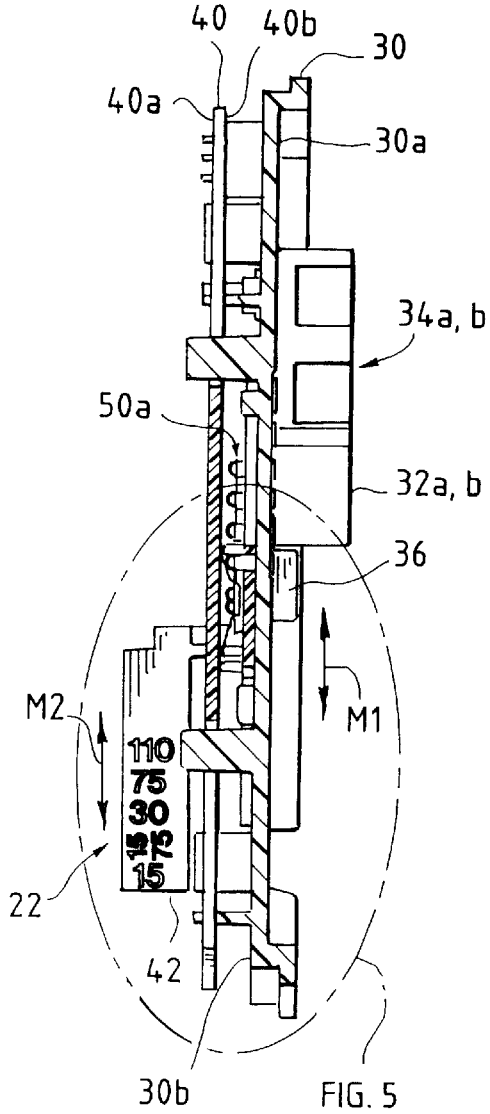
FIG. 4 is a side sectional view taken along plane 4—4 of FIG. 3.
Figure 5:
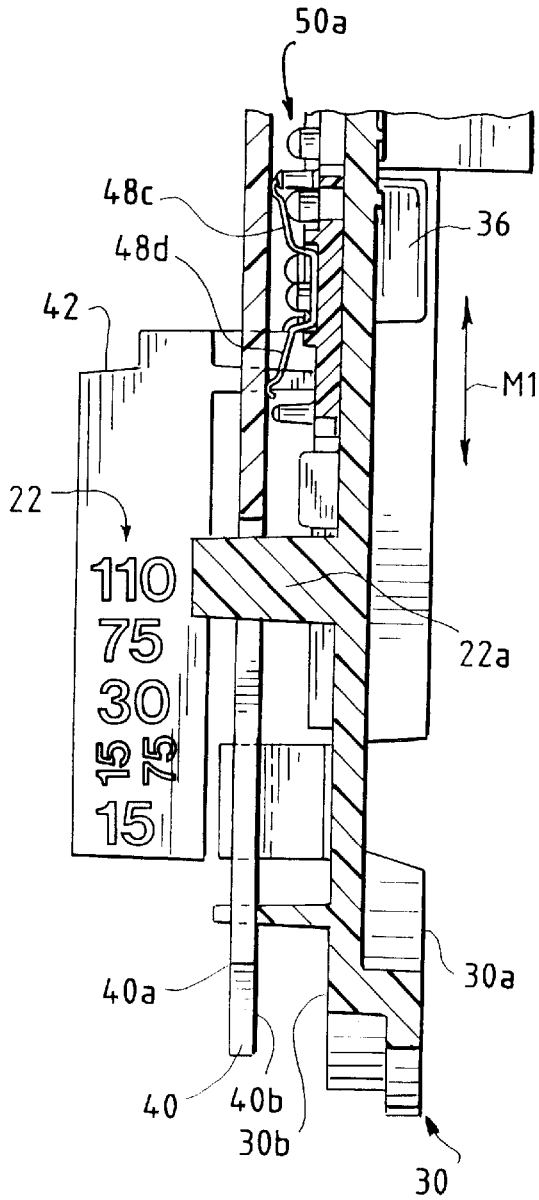
FIG. 5 is an enlargement of a portion of FIG. 4.

In a disclosed exemplary embodiment, the movable output indicating member 22 has an elongated indicia carrying body portion 42 which is oriented so as to be generally perpendicular to the plane of printed circuit board 40. The body portion 42 is coupled to an elongated planar member 44 oriented generally parallel to the printed circuit board 40, perpendicular to the body portion 42 and between lower surface 42 and base 30, best seen in FIG. 4. As indicated in FIGS. 3 and 4, linear movement of manually actuatable member 36, on the exposed surface 30*a* of base 30 in direction M1 is coupled to indicator 22 producing corresponding movement M2 thereat.

The member 44 is in turn coupled to the manually actuatable element 36 which extends generally parallel to the body 42 of indicator 22. As illustrated in FIG. 4, member 36 extends through wall or base 30.

A plurality of detent members, fixed to surface 30*b*, 50*a* and 50*b*, extend linearly generally parallel to the member 44. The member 44 carries engaging cam surfaces 44*a* and 44*b* which slidably engage respective members of the pluralities 50*a, b* as the manually actuatable member 36 is moved, for example, in a direction M1. The interaction between the pluralities 50*a*, 50*b* and camming surfaces 44*a*, 44*b* provide slidably engaging detent-type functionality to provide feedback to an installer that the member 36 has been located in one of a plurality of candela selecting positions.

It will be understood that while two sets of pluralities 50*a*, 50*b* have been illustrated, a single set would suffice and would come within the spirit and scope of the present invention. The cam surfaces 44*a*, 44*b* are carried on respective deflectable arcuate members 46*a* and 46*b* which have a cantilever structure and are coupled at a single end to planer member 44. Hence, the members 46*a*, 46*b* deflect as the surfaces 44*a*, 44*b* slidably engage the fixed members of the pluralities 50*a*, 50*b*. This arrangement could be reversed.

Figure 6:
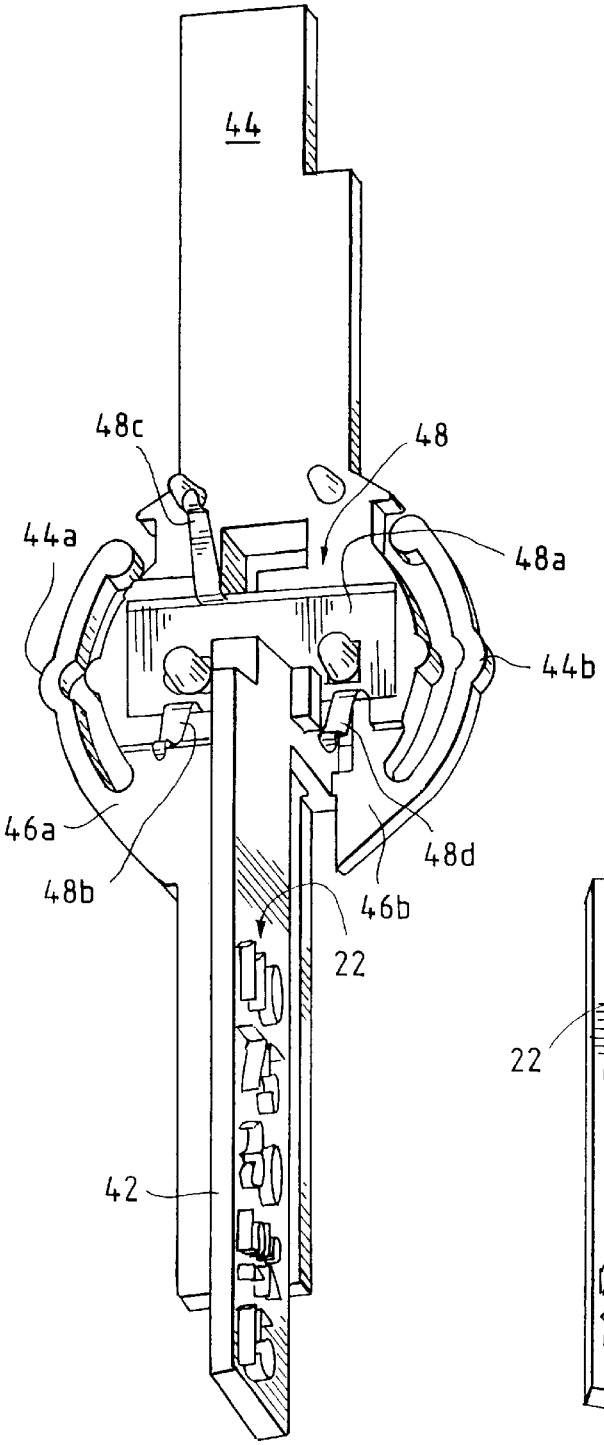
FIG. 6 is a rendering illustrating a portion of the candela selection structure of the unit of FIG. 1.
Figure 7:
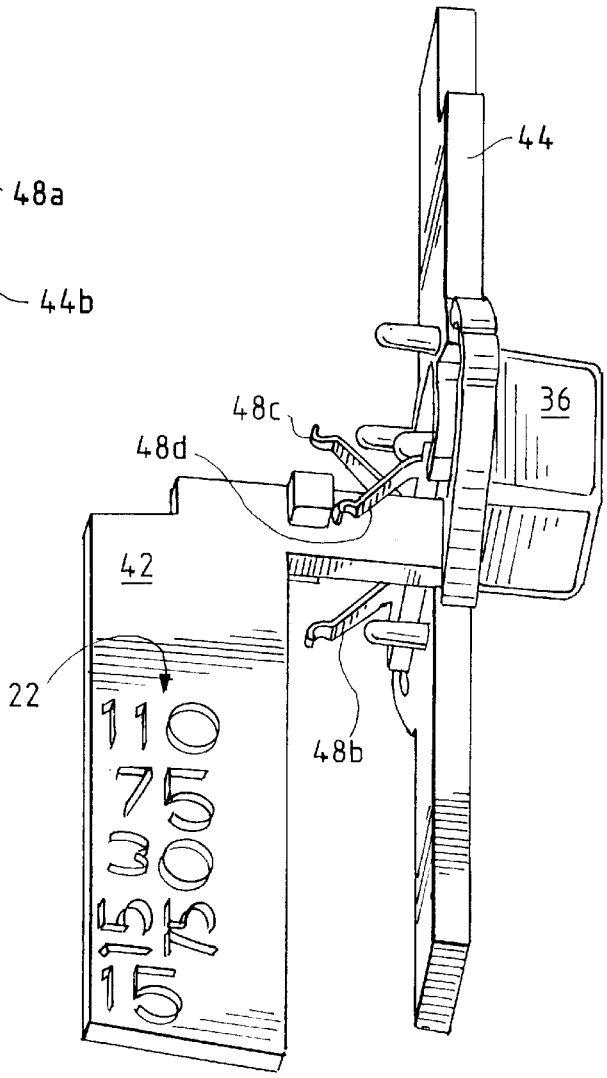
FIG. 7 is a rendering from a different perspective of the element of FIG. 6.

The member 44 also carries a conductive switching element generally indicated at 48, best seen in FIGS. 6 and 7. The switch element 48 has a central body portion 48*a* and first, second and third switching elements, implemented as arms 48*b*, 48*c* and 48*d*. The members 48, *b, c*, carry out switching functions as the member 44 slides linearly in response to the manually operable member 36 moving in the direction M1 or opposite M1. Member 48*d* is used to counter, or balance spring force loading and is not needed to implement a switching function. Alternately, a self-contained modular switch could be used.

Figure 8:
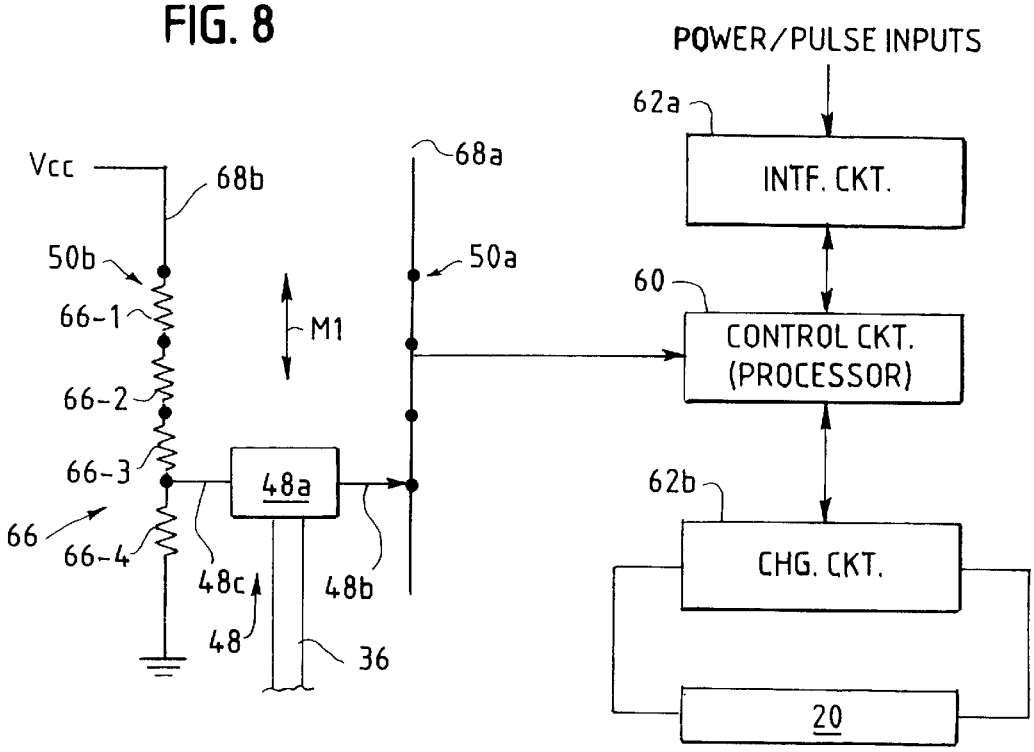
FIG. 8 is a schematic block diagram of electrical circuitry in accordance with the present invention.

FIG. 8 illustrates some of the electrical circuitry of the unit 10. The unit 10 includes control circuits 60, which could be implemented as a programmed processor. The control circuits 60 are in turn coupled to interface circuits 62*a* for receipt of electrical energy and/or control signals. Control circuitry 60 is also coupled to charging circuitry 62*b* which is in turn coupled to radiant energy source 20 for energizing same on an intermittent basis to produce a quantum output of visible light.

A resistor ladder network 66, having members 66-1, -2, -3, -4, provides a plurality of different, candela indicating voltages which can be coupled, one at a time, via switch element 48 to control circuits 60. In this configuration, all members of the resistor ladder network 6*b* are active in the circuit irrespective of the setting of the candela selecting switch element 48 (coupled to manually operable handle 36).

Conductive members 48*b, c* slidably engage, on one hand, conductor 68*a* and on the other hand, segments of conductor 68*b* which extend between resistive elements 66-1, -2, -3 and -4 as member 48*a*, and switching conductors 48*b, c* are moved using switch handle 36. Detents 50*a, b* are schematically indicated on FIG. 8.

Alternately, the discrete voltage establishing resistors 66-1, -2, -3, -4 of FIG. 8 could be replaced with a potentiometer which provides a continuously varying input voltage to the control circuits. This in turn can be used to vary a duty cycle.

One form of processor controlled strobe with which the present invention could be used was disclosed and described in a U.S. patent application filed Jan. 23, 2001 entitled "Processor Controlled Strobe", Ser. No. 09/767,897 assigned to the assignee hereof and incorporated herein by reference. In this circuit configuration, a storage element for a strobe, a capacitor, is charged with a constant frequency, variable duty cycle signal. Duty cycle can be varied by the setting of a switch such as switch 48.

The switch 48 is in turn coupled to control circuits 60 via switching members 48*b, c*. The setting of the manually operable member 36, which is in turn coupled to switch member 48 provides a variable voltage electrical signal to control circuits 60 indicative of the desired candela output. Control circuitry 60 in turn utilizes energy received via interface circuit 62*a*, via charging circuitry 62*b*, to energize source 20 on a periodic basis in accordance with the preset candela output. It will be understood that the exact details of control circuitry 60, interface circuit 62*a* and charging circuitry 62*b* would be understood by those of skill in the art.

Thus, in accordance with the present invention, no component changes are necessary, no multi-terminal variable inductors are necessary, and, instead of switching components in and out of the circuit, all components are constantly in use in the present instance.

Figure 9:
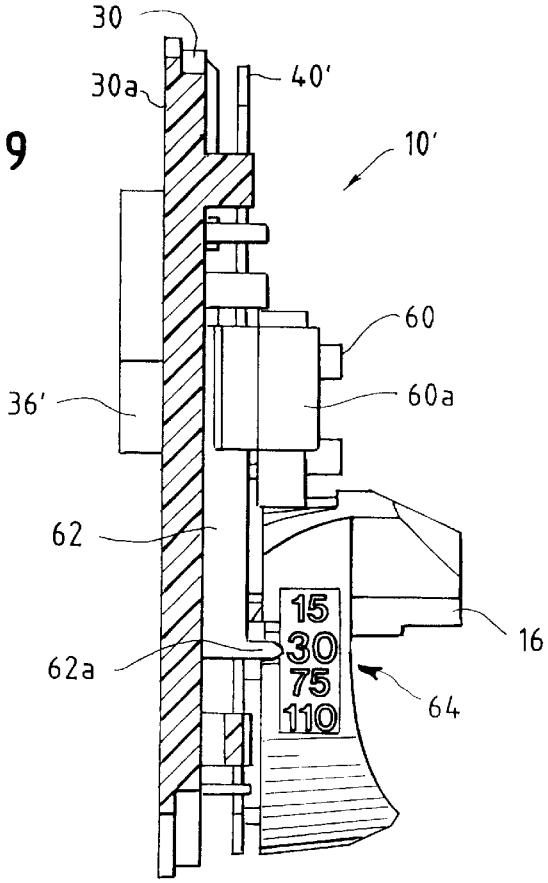
FIG. 9 is a side sectional view of an alternate audible output device in accordance with the present invention.

FIG. 9 illustrates an alternate embodiment of an electrical unit 10' in accordance with the present invention. The unit 10' includes a housing, comparable to the housing 12 and a back panel 30. The unit 10' includes a printed circuit board 40' which carries a reflector, such as the reflector 16.

The candela setting for the unit 10' is set by a movement of a manually actuatable member 36' available for setting by an installer adjacent surface 30*a*. The settable member 36' is in turn coupled to a self-contained slide switch 60 via switch actuator arm 60*a*. As the member 36' is moved to a position indicative of a desired candela setting, an indicator arm 62, coupled thereto, attracts movement thereof and indicates, by movement of pointer 62*a*, relative to a fixed candela indicating scale 64 what the preset output level is. The position of the pointer 62*a* relative to the scale 64 is visible after the unit 10' has been mounted on a respective electrical unit. When so-mounted, the manually actuatable member 36' is not accessible.

Figure 10A:
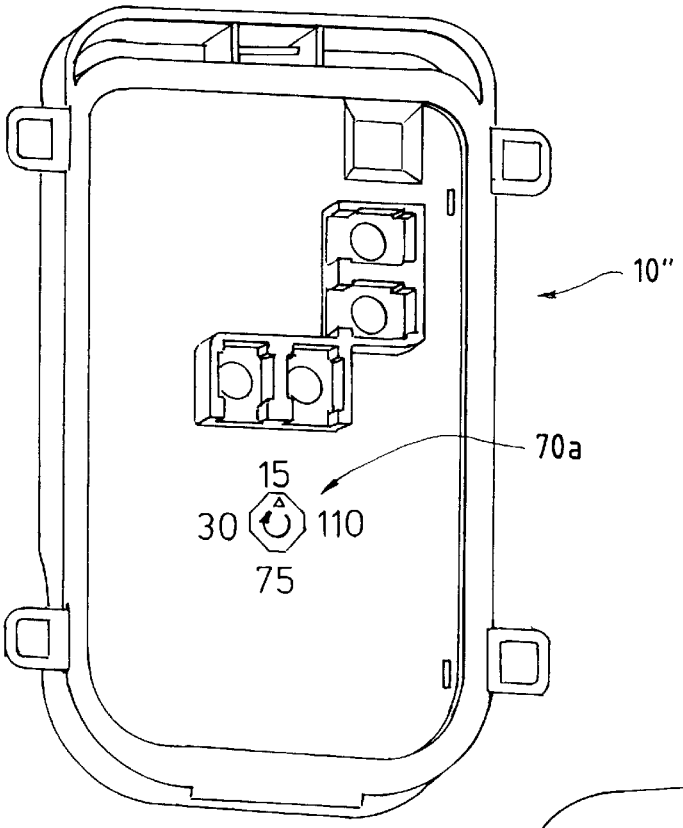
FIGS. 10A and 10B together illustrate rear and front views of yet another visible output device in accordance with the present invention.
Figure 10B:
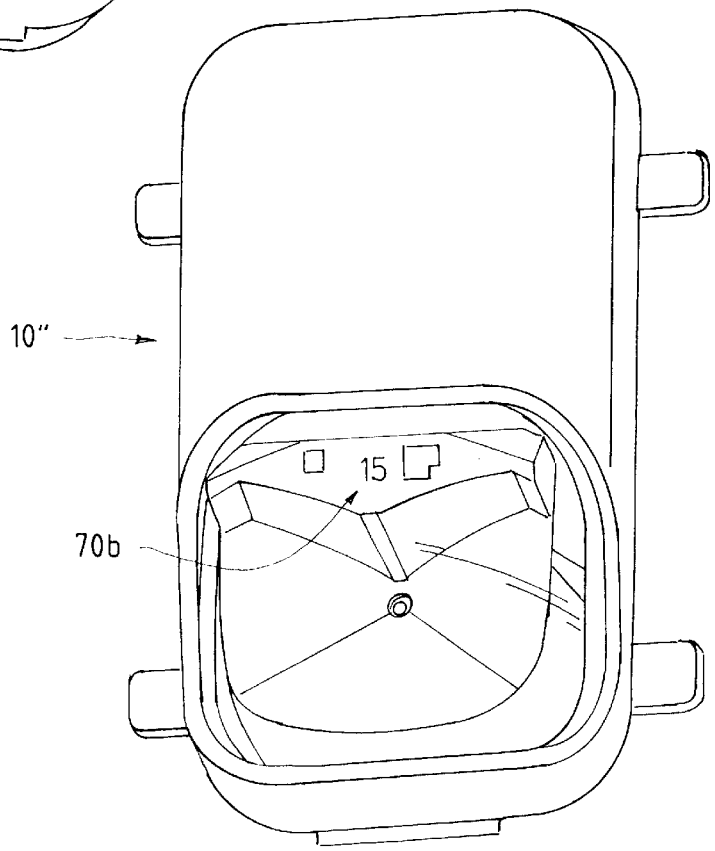

FIGS. 10A and 10B illustrate respectively a rear, electrical box side, and a front of a visual output unit 10" in accordance with the present invention. The unit 10" includes a rotatable candela selection member 70*a* mounted on a rear side of the unit 10". The member 70*a* can be set prior to installation to a desired output level. Once installed, the member 70*a* is located adjacent the respective electrical box and is not accessible. Instead, a rotatable display 70*b*, coupled to the member 70*a*, is visible via the lens of the unit 10" for confirmation of the output setting.

Figure 11A:
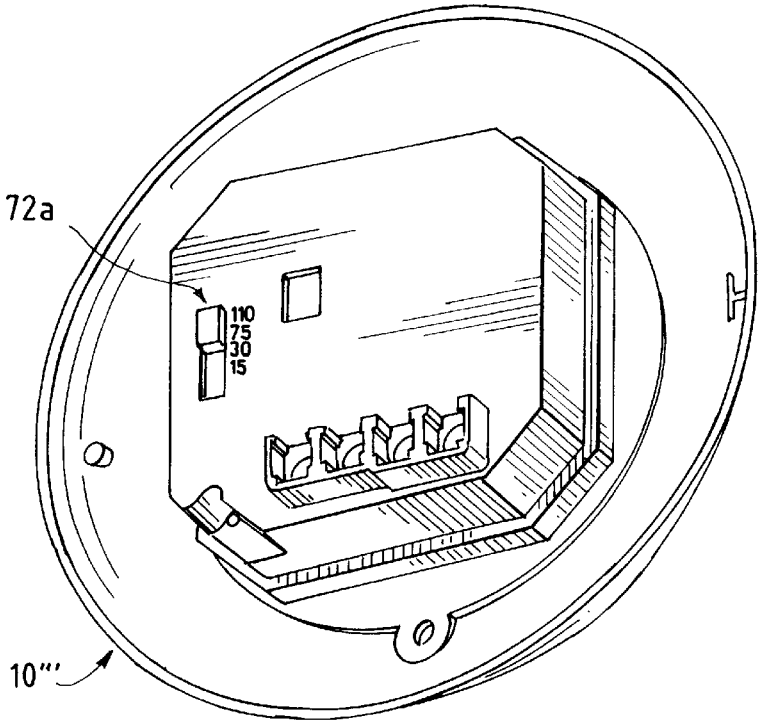
FIGS. 11A and 11B taken together represent yet another form of a visible output device in accordance with the present invention.
Figure 11B:
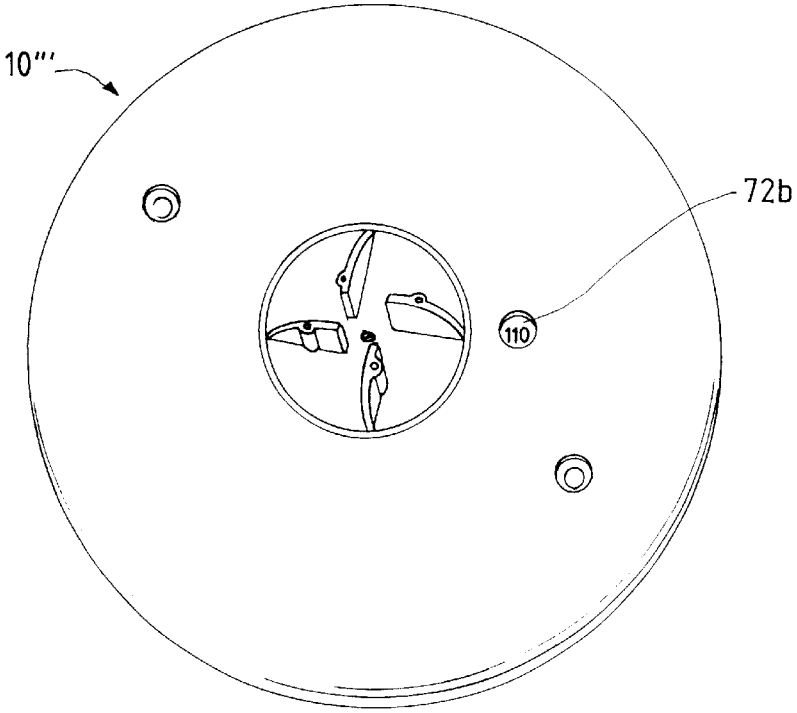

FIGS. 11A and 11B together illustrate respectively a rear, electrical box side, and a front side of a ceiling mounting visible output unit 10'". The unit 10'" carries a manually settable member 72*a* on the rear or electrical box side of the unit 10'" . The member 72*a* can be set to a desired candela output level prior to installing the unit 10'" on the respective electrical box. When so-installed, the manually adjustable member 72*a* is not accessible.

As illustrated in FIG. 11B, a visual display 72*b*, coupled to the member 72*a*, is viewable for confirmation of the setting of the candela output level.

It will be understood that a variety of coupling arrangements can be used between the manually adjustable member, such as the member 72*a* and the output indicating member 72*b* without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A strobe unit installable on an electrical box, the strobe unit comprising:

a housing which carries a flashable strobe;

an output selecting device, located on a selected surface, not accessible for adjustment when the housing has been installed, wherein the device is manually adjustable to alter an illumination parameter of the strobe; and an output indicating display, alterable in response to manually adjusting the device, wherein an indicated output, responsive to a setting of the device, is visible by an observer when the housing has been installed.

2. A unit as in claim 1 wherein the display comprises an adjustable mechanical readout element.

3. A unit as in claim 1 which includes a mechanical linkage between the device and the display.

4. A unit as in claim 3 wherein at least part of the mechanical linkage is rotatably operable for altering the illumination parameter.

5. A unit as in claim 4 wherein at least part of the display is rotatably coupled to the rotatably operable part of the mechanical linkage.

6. A unit as in claim 1 wherein the housing includes a viewing window for the display.

7. A unit as in claim 6 wherein the display is slidably alterable relative to the viewing window.

8. A unit as in claim 7 wherein the housing carries control circuitry coupled to the strobe and to the selecting device wherein the control circuitry is responsive to a setting of the device to adjust an output level of the strobe in accordance therewith.

9. A unit as in claim 8 wherein the device comprises an electrical switch.

10. A unit as in claim 8 wherein the control circuitry comprises an energy input port for receiving electrical energy with an input voltage valve in a range on the order of 6–33 volts.

11. A unit as in claim 10 wherein the control circuitry comprises charging circuitry for energizing the strobe in accordance with both the setting of the device and the received input voltage value.

12. A unit as in claim 11 wherein the charging circuitry adjusts a charging rate in response to both the setting of the device and the received input voltage value.

13. A unit as in claim 1 which includes a second output indicating display, carried on the selected surface, wherein the second display is visible while the selecting device is being adjusted and not visible after installation.

14. A unit as in claim 13 wherein the second display is one of linearly movable, and rotatably movable in response to movement of the selecting device.

15. A unit as in claim 8 wherein the device comprises a rotatable portion linked to a linearly movable portion which carries the output indicating display.

16. A unit as in claim 15 wherein the linearly movable portion is slidably carried by the housing.

17. A unit as in claim 15 wherein the housing has a mounting side surface wherein the selecting device has a manually movable portion adjacent to the mounting side surface.

18. A unit as in claim 17 which carries an illumination scale on the mounting side surface adjacent to the manually movable portion.

19. A unit as in claim 17 wherein the movable portion engages an electrical switch.

20. A unit as in claim 19 wherein the housing carries control circuits and an output of the switch is coupled thereto.

21. An adjustable alarm output device comprising:

a housing which has an output side and a mounting side;

an alarm indicating output transducer carried by the housing for emitting an alarm indication from the output side;

a manually adjustable structure, carried by the housing and settable from the mounting side, to one of a plurality of positions for setting an output parameter of the transducer; and a parameter indicating visual display observable on the output side and coupled to the manually adjustable structure whereby the visual display tracks and visually confirms the setting of the manually adjustable structure.

22. A device as in claim 21 which includes an apparatus carried on the housing for attaching the housing to an electrical box.

23. A device as in claim 22 wherein the output transducer is selected from a class which includes at least a visual alarm indicating device and an audible alarm indicating device.

24. A device as in claim 21 wherein the manually adjustable structure comprises one of a linearly movable member and a rotatable member.

25. A device as in claim 24 wherein the visual display includes one of a linearly movable display element and a rotatable display element responsive to the respective manually adjustable structure.

26. A device as in claim 25 wherein the output transducer is selected from a class which includes at least a visual alarm indicating device and an audible alarm indicating device.

27. A device as in claim 21 which includes a mechanical detent coupled to the manually adjustable structure wherein the detent is slidably engageable as the manually adjustable structure is moved from a first position to a second position.

28. A device as in claim 27 wherein the detent comprises, in part, a first, movable portion, carried on the manually adjustable structure.

29. A device as in claim 28 wherein the detent comprises a second portion fixed on the housing whereby the first and second portions slidably engage one another as the manually adjustable structure moves between settable positions.

30. A device as in claim 29 which includes control circuits coupled top the output transducer and at least one switching element, carried by the manually adjustable structure wherein the element couples a position indicating electrical signal to the control circuits.

31. A device as in claim 29 wherein the second portion comprises a plurality of spaced apart detent members.

32. A device as in claim 29 wherein one of the portions comprises a deflectable spring biased member.

33. A device as in claim 29 which includes a position indicating component selected from a class which includes a self-contained modular switch, and, a plurality of spaced-apart electrical conductors.

* * * * *